US011283220B2

(12) United States Patent
Bergner et al.

(10) Patent No.: US 11,283,220 B2
(45) Date of Patent: Mar. 22, 2022

(54) CONTACT TERMINAL WITH AT LEAST ONE IMPEDANCE CONTROL FEATURE

(71) Applicants: TE Connectivity Germany GmbH, Bensheim (DE); TE Connectivity India Private Limited, Karnataka (IN)

(72) Inventors: Bert Bergner, Rimbach (DE); Sundareshan M D, Karnataka (DE); Gururaj A. Hiremath, Karnataka (IN)

(73) Assignees: TE Connectivity India Private Limited, Bangalore (IN); TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 17/002,256

(22) Filed: Aug. 25, 2020

(65) Prior Publication Data

US 2021/0066855 A1 Mar. 4, 2021

(30) Foreign Application Priority Data

Aug. 27, 2019 (EP) ..... 19193934

(51) Int. Cl.
*H01R 13/646* (2011.01)
*H01R 13/6581* (2011.01)

(52) U.S. Cl.
CPC ..... *H01R 13/646* (2013.01); *H01R 13/6581* (2013.01)

(58) Field of Classification Search
CPC ..... H01R 13/646; H01R 13/6581; H01R 13/6473; H01R 13/6474; H01R 13/6477; H01R 13/6593
USPC ..... 439/607.04
See application file for complete search history.

(56) References Cited

U.S. PATENT DOCUMENTS 6,015,315 A * 1/2000 Ensign ..... H01R 24/44 439/578
6,454,605 B1 * 9/2002 Bassler ..... H01R 13/6471 439/607.23
6,457,983 B1 * 10/2002 Bassler ..... H01R 4/66 439/101
7,198,509 B2 * 4/2007 Takasu ..... H01R 24/44 439/485
7,270,573 B2 * 9/2007 Houtz ..... H01R 12/585 439/607.05
7,347,721 B2 * 3/2008 Kameyama ..... H01R 13/6477 439/498
7,387,531 B2 * 6/2008 Cook ..... G01R 31/58 439/578

(Continued)

OTHER PUBLICATIONS

Extended European Search Report, dated Feb. 19, 2020, 9 pages.

*Primary Examiner* — Peter G Leigh
(74) *Attorney, Agent, or Firm* — Barley Snyder

(57) ABSTRACT

A contact terminal includes a terminal shield, a contact carrier, and a contact element for conducting electrical signals of a high-frequency data transmission. The contact carrier retains the contact element in a fixed position within the terminal shield. The terminal shield has a discontinuity that affects an impedance of the contact element. At least one of the contact carrier and the contact element has an impedance control feature configured to adjust the impedance of the contact element to a predefined desired value according to a frequency of the data transmission.

19 Claims, 6 Drawing Sheets

(56) References Cited

U.S. PATENT DOCUMENTS

| | | | | |
|---|---|---|---|---|
| 7,731,528 | B2 * | 6/2010 | Feldman | H01R 13/6592 439/578 |
| 7,967,636 | B2 * | 6/2011 | Jin | H01R 12/712 439/607.05 |
| 8,323,055 | B2 * | 12/2012 | Plate | H01R 13/6593 439/578 |
| 10,116,097 | B2 * | 10/2018 | Nakashima | H01R 4/184 |
| 2011/0092096 | A1 | 4/2011 | Jin et al. | |

* cited by examiner

CONTACT TERMINAL WITH AT LEAST ONE IMPEDANCE CONTROL FEATURE

CROSS-REFERENCE TO RELATED APPLICATION

This application claims the benefit of the filing date under 35 U.S.C. § 119(a)-(d) of European Patent Application No. 19193934.7, filed on Aug. 27, 2019.

FIELD OF THE INVENTION

The present invention relates to a contact terminal and, more particularly, to a shielded contact terminal for high-frequency data transmission.

BACKGROUND

In the field of data transmission, transmission line components such as connectors, cables, receptacles and the like are usually surrounded by a shielding to maintain the transmission performance. The shielding mainly provides for protection against undesired external influences such as mechanical impacts and electromagnetic effects.

In applications where high-frequency data transmission is required, the design of the shielding itself can have an influence on the encompassed components, which deteriorates the signal quality and transmission performance, respectively. The shielding tends to have design features that are indispensable due to their functionality, especially at transition points between transmission line components. These, however, can have a deteriorating influence. Thus, a limiting factor exists in terms of design flexibility of the shielding at transition points.

SUMMARY

A contact terminal includes a terminal shield, a contact carrier, and a contact element for conducting electrical signals of a high-frequency data transmission. The contact carrier retains the contact element in a fixed position within the terminal shield. The terminal shield has a discontinuity that affects an impedance of the contact element. At least one of the contact carrier and the contact element has an impedance control feature configured to adjust the impedance of the contact element to a predefined desired value according to a frequency of the data transmission.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
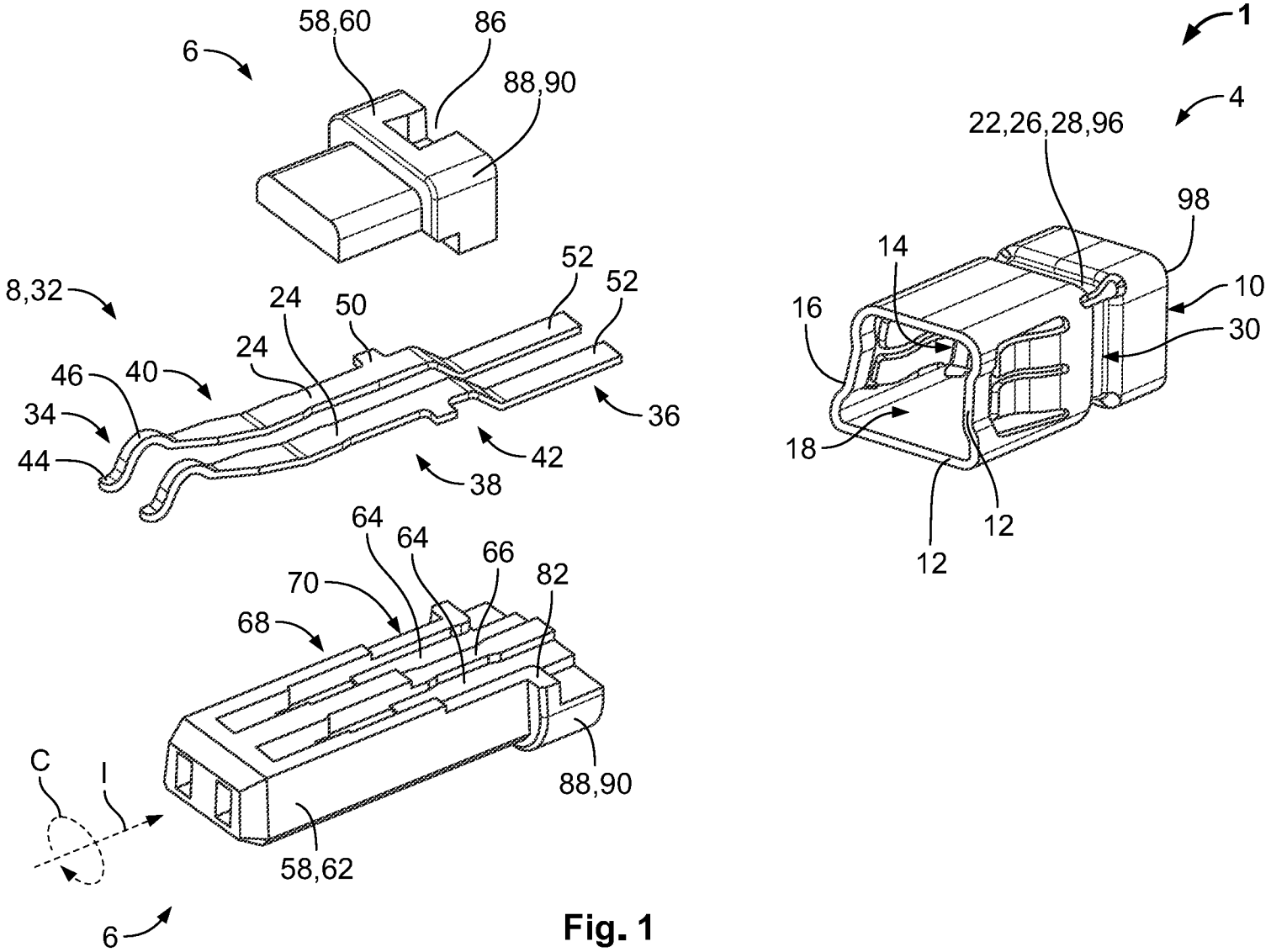
FIG. 1 is an exploded perspective view of a contact terminal according to an embodiment.

In the following, exemplary embodiments of the invention are described with reference to the drawings. The shown and described embodiments serve explanatory purposes only. The combination of features shown in the embodiments may be changed according to the description. For example, a feature which is not shown in an embodiment but described may be added, if the technical effect associated with this feature is beneficial for a particular application. Vice versa, a feature shown as part of an embodiment may be omitted if the technical effect associated with this feature is not needed in a particular application. In the drawings, elements that correspond to each other with respect to function and/or structure have been provided with the same reference numeral.

Figure 7:
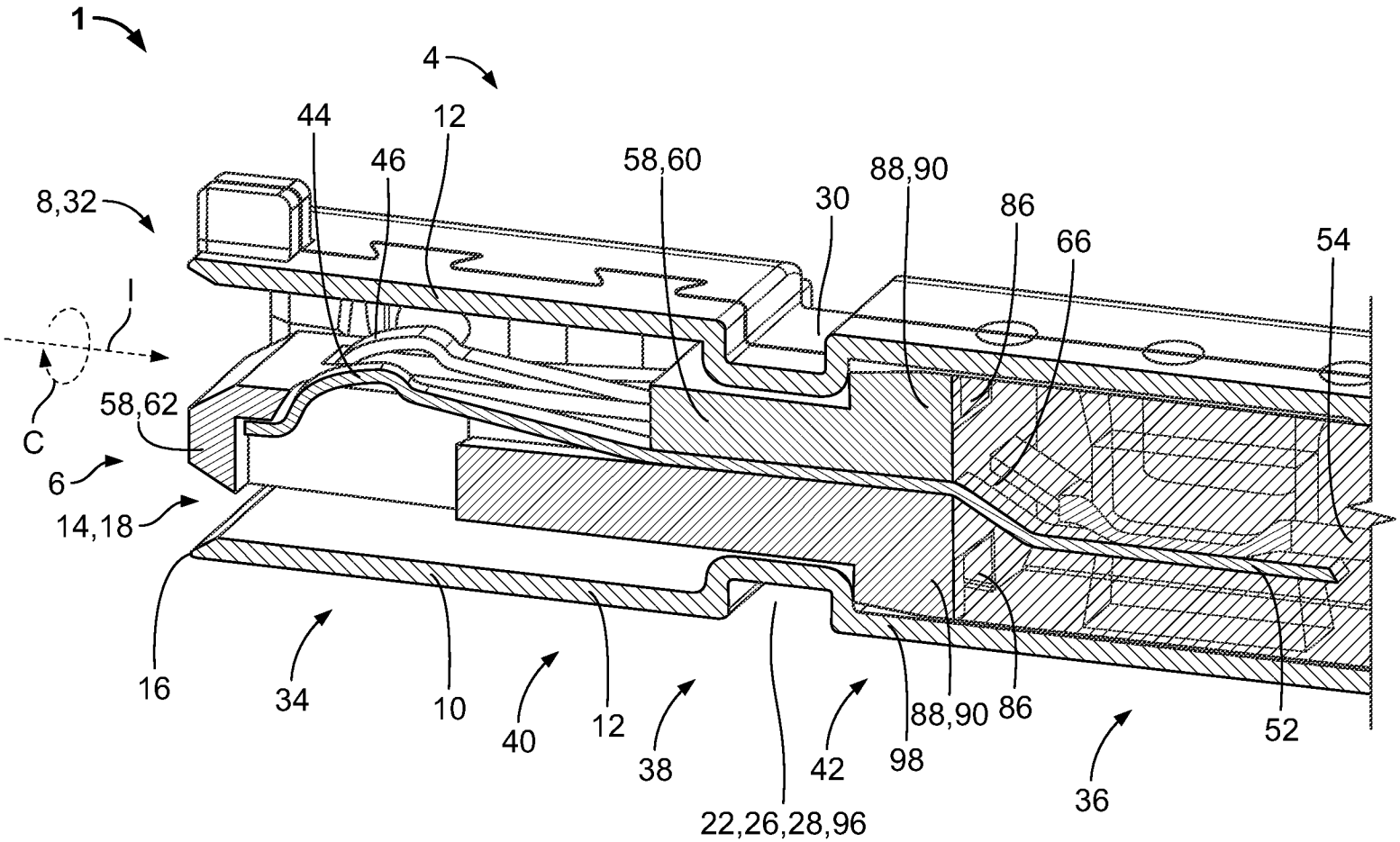
FIG. 7 is a sectional perspective view of the a contact terminal according to another embodiment.
Figure 8:
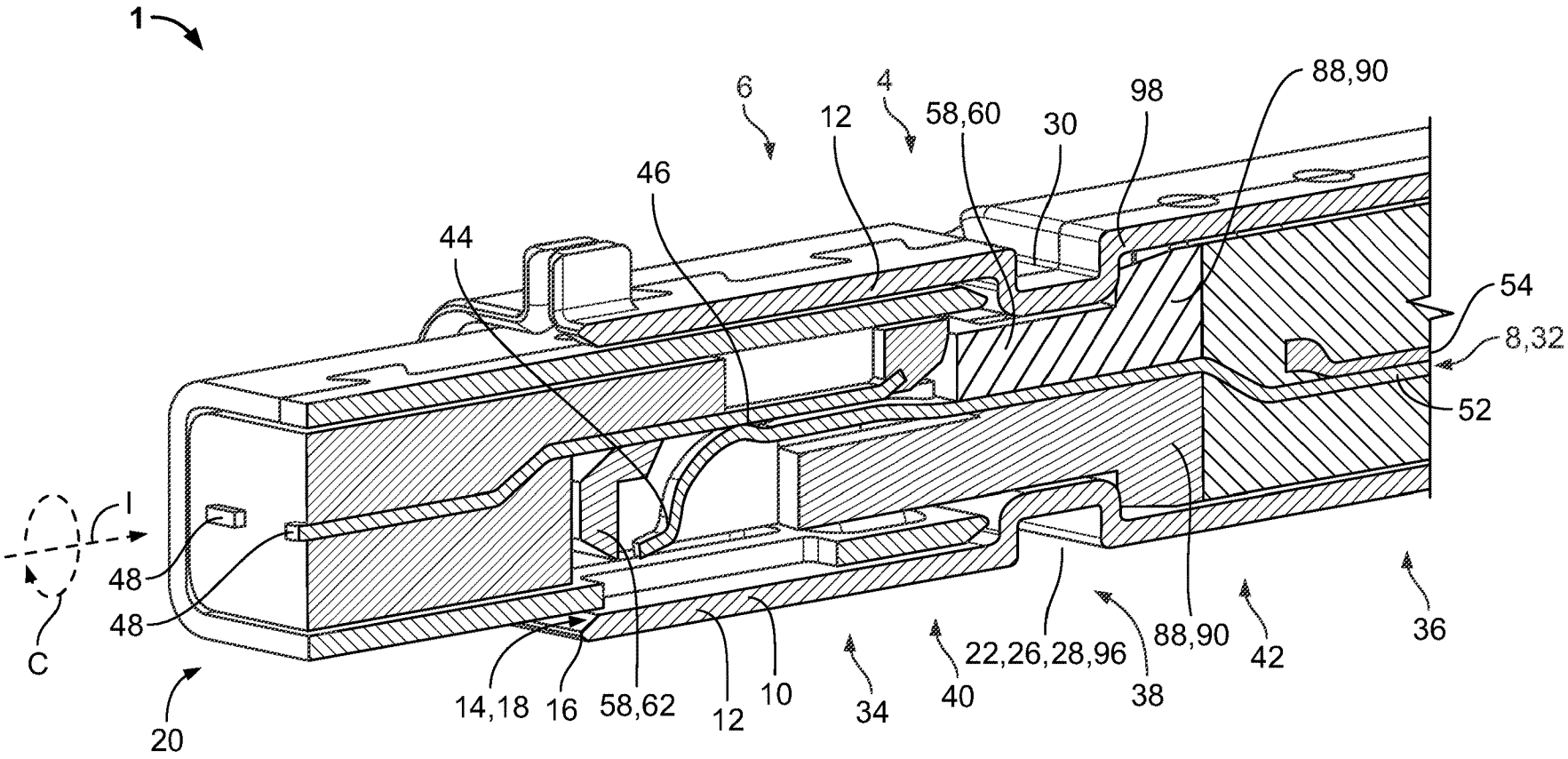
FIG. 8 is a sectional perspective view of the contact terminal of FIG. 7 mated with a mating connector.
Figure 9:
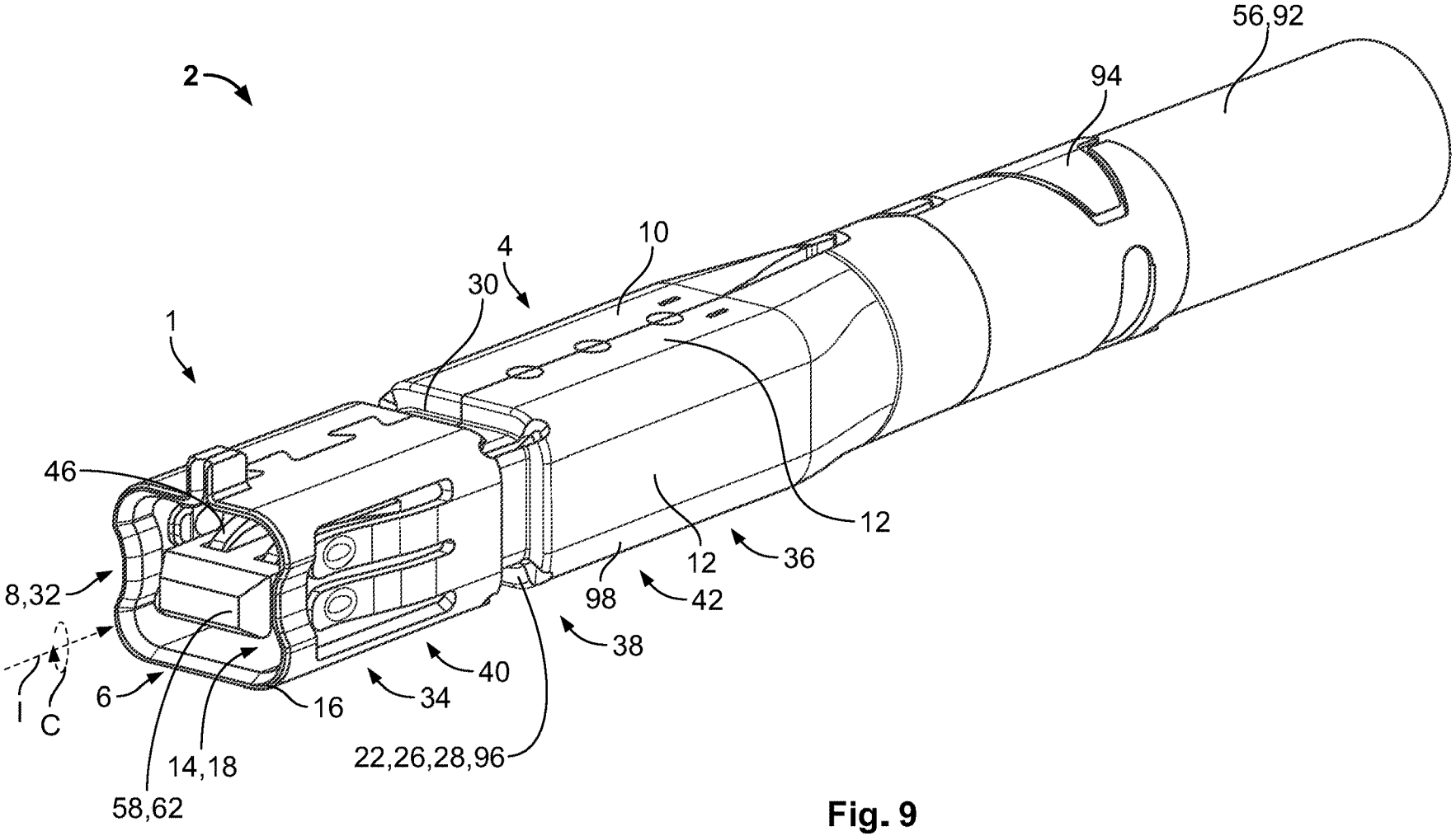
FIG. 9 is a perspective view of a cable assembly according to an embodiment including the contact terminal of FIG. 7.

A contact terminal 1 according to various embodiments is shown in FIGS. 1-8. A cable assembly 2 according to an embodiment is shown in FIG. 9.

FIG. 1 shows an exploded view of the contact terminal 1 according to one possible embodiment of the present disclosure. The contact terminal 1, as shown in FIG. 1, comprises a terminal shield 4, a contact carrier 6, and a pair of contact elements 8 for conducting electrical signals of a high-frequency data transmission. As can be seen from FIG. 2, the contact carrier 6 retains the pair of contact elements 8 in a fixed position within the terminal shield 4. The contact elements 8 are positioned spaced apart and electrically isolated from each other. More particularly, the terminal shield 4 may enclose the contact carrier 6 and the pair of contact elements 8 along their entire length in an embodiment.

The at least one contact element 8 may be a tab- or pin-like spring beam stamped from an electrically-conductive sheet material, e.g. a metal sheet. In an embodiment, each of the pair of contact elements 8 may be configured to transmit one signal of a differential pair of signals for high-frequency data transmission. This embodiment allows for data transmission that is less prone to electromagnetic noise, due to the transmission of a differential pair of signals.

As shown in FIG. 1, the terminal shield 4 is a bent metal sheet 10, and in the shown embodiment includes at least four shield walls 12 arranged in a circumferential direction C around a lead through-opening 14 extending along an insertion direction I. At at least one forward end 16, the terminal shield 4 has an opening 18 at which the terminal shield 4 may receive a mating connector 20 inserted along the insertion direction I, as shown in FIG. 8. Alternatively, the terminal shield 4 may be a metal shield made of a woven material. The terminal shield 4 provides a protection for the contact carrier 6 and the contact elements 8 against electromagnetic effects, further improving signal integrity.

In general, impedance is the property of electrical conductors measuring their resistance against the flow of an alternating current. Impedance is influenced by several factors such as the material and dimensions of the electrical conductor itself, by the medium surrounding the conductor (dielectric material) and by other electrically conductive components in proximity of the electrical conductor, especially the relative distance between the respective surfaces.

If during the transmission of an electrical signal from a signal source to a signal receiver (load) via a transmission line, the impedance of the load and the impedance of the transmission line is not matched (impedance mismatch), signal reflection may occur. Signal reflection impairs signal integrity and is therefore an unwanted phenomenon. The cause of such an impedance mismatch and subsequent signal reflection may be a non-linear change and/or discontinuity in the components of the transmission line.

Figure 4:
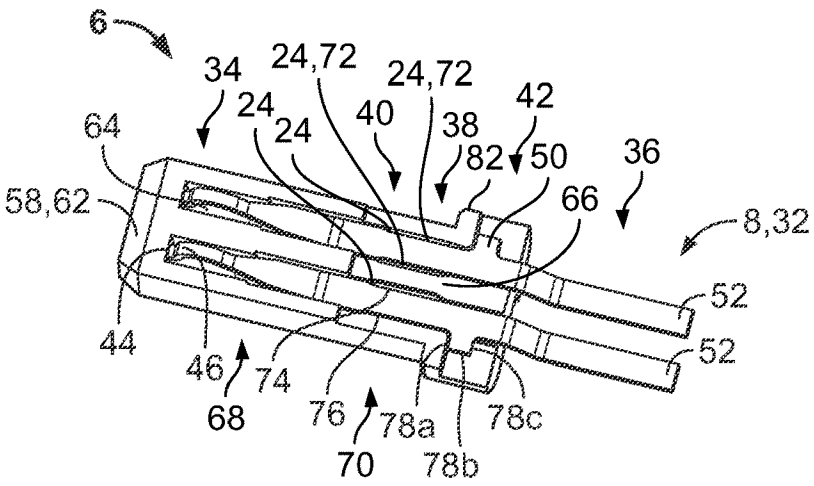
FIG. 4 is a perspective view of a bottom piece of the contact carrier and a pair of contact elements of the contact terminal of FIG. 1.
Figure 2:
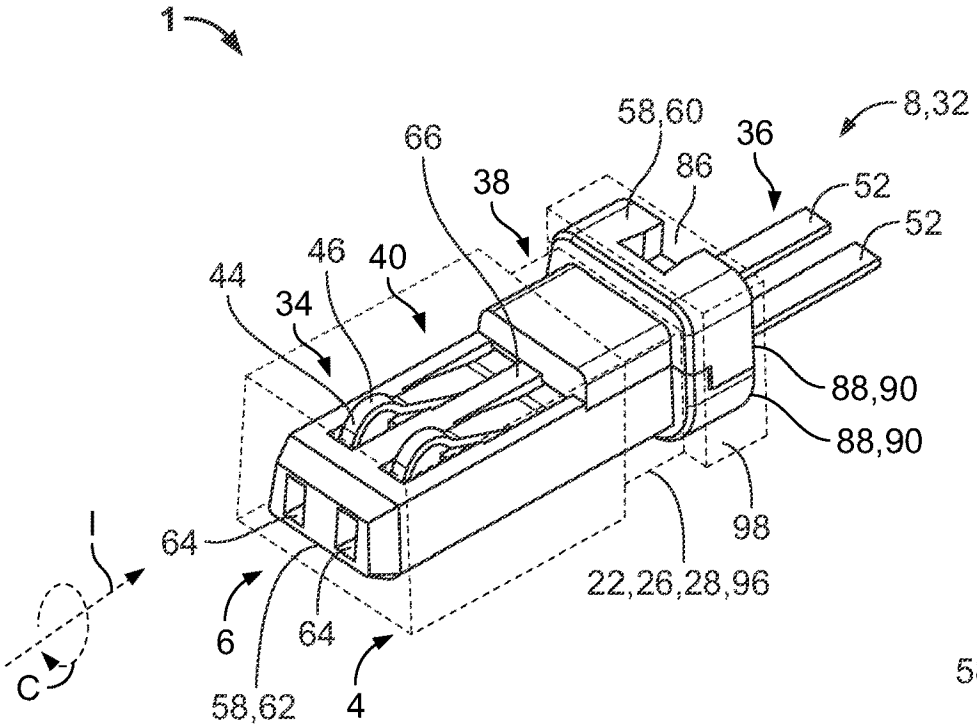
FIG. 2 is a perspective view of a contact carrier and a pair of contact element of the contact terminal of FIG. 1.
Figure 5:
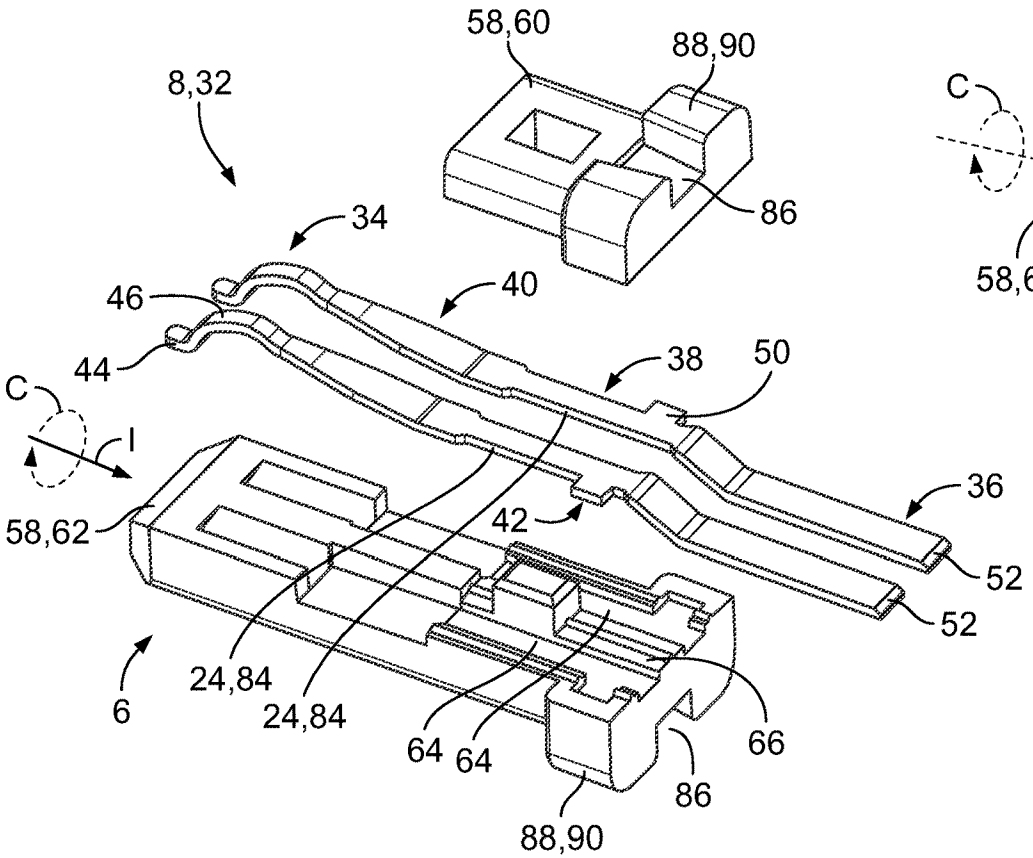
FIG. 5 is an exploded perspective view of a contact carrier and a pair of contact elements according to another embodiment.

The terminal shield 4 may have a discontinuity 22 in its design, shown in FIG. 1, that affects the impedance of the pair of contact elements 8. In order to compensate for the effect of this discontinuity 22, multiple impedance control features 24 may be implemented on the contact carrier 6 and/or the pair of contact elements 8. In an embodiment, the contact carrier 6 and each of the pair of contact elements 8 may possess at least one impedance control feature 24, and all impedance control features 24 may be aligned with the discontinuity 22 of the terminal shield 4 or at least be positioned in immediate proximity thereto. This is shown in FIGS. 1, 4 and 5, and will be described in detail further below.

The impedance control feature 24 may be in the vicinity of and/or locally limited to the area of influence of the discontinuity 22, thus concentrating and maximizing the effect of the impedance control feature 24. The impedance control feature 24 is configured to adjust the impedance of the contact elements 8 to a predefined desired value according to the frequency of the data transmission. Such a predefined, desired value may be the impedance of the load. This compensates for at least one cause of impedance mismatch and thus reduces signal reflection. Therefore, the signal integrity of the transmitted signal is substantially improved.

The at least one impedance control feature 24 may comprise or be an adjusted material thickness of the contact carrier 6. In particular, the material thickness of the contact carrier 6 can be adjusted in the direct vicinity of the discontinuity 22 of the terminal shield 4. The adjustment of material thickness is an impedance control feature 24 that allows for an easy adjustment of yet another impedance-influencing factor, namely the relative permittivity of the dielectric material.

As shown in the embodiments of FIGS. 1, 2, 7, 8, and 9, the discontinuity 22 may be a locking element 26, such as a locking groove 28 formed integrally by the terminal shield 4, extending along the outer circumference 30 of the terminal shield 4 and radially inwards toward the contact carrier 6. In particular, the terminal shield 4 may have a reduced outer traverse cross-section and a reduced inner traverse cross-section at the locking groove 28. The difference in the traverse cross-section between the locking groove 28 and the rest of the terminal shield 4 is covered by the terminal shield 4. The locking groove 28 may provide a seat for a complementary locking element, e.g. of a suitable receptacle. The locking groove 28 can easily be manufactured by bending or pressing.

The terminal shield 4 has a section 96 with a reduced cross-section and a section 98 with an increased cross-section in a direction perpendicular to the insertion direction I, as shown in FIGS. 7-9. The pair of contact elements 8 have a cross-section reduction corresponding to the section 96 and a cross-section increase corresponding to the section 98. The cross-section reduction overlaps with the section 96 with the reduced cross-section in a direction perpendicular to the insertion direction I. The cross-section increase overlaps with the section 98 with the increased cross-section in the insertion direction I.

The pair of contact elements 8 may be a pair of electrically conductive spring beams 32, which flatly extend in the insertion direction I, as shown in FIG. 1. The pair of spring beams 32 may be formed mirror-invertedly to each other and positioned spaced apart from each other. Each of the spring beams 32 has a contact portion 34 on a first end, a bonding portion 36 on a second end opposite the first end, and an impedance control portion 38 in between the contact portion 34 and the bonding portion 36. Each spring beam 32 has a transition portion 40 between the contact portion 34 and the impedance control portion 38 and a retention portion 42 between the impedance control portion 38 and the bonding portion 36.

The contact portion 34 may have a curved tip 44 with a contact area 46, shown in FIG. 1, configured for engaging in electrical contact with a signal contact 48 of the mating connector 20, as shown in FIG. 8. During the engagement, the curved tip 44 of the contact portion 34 may be mechanically deflected by the signal contact 48 in a direction perpendicular to the insertion direction I.

The transition portion 40 may be positioned adjacent to the contact portion 34 and comprise a first bevel transition, which in the insertion direction I gradually widens the width of the transition portion 40 up to a maximum width of the transition portion 40, as shown in FIG. 1. A second bevel transition gradually narrows the width of the transition portion 40 in the insertion direction I towards the impedance control portion 38. An inner surface of the cavity 6 abuts against the transition portion 40 to prevent lateral movement of the contact elements 8 though abutment and longitudinal movement through friction.

The impedance control portion 38 may be positioned adjacent to the transition portion 40 and extend along with the locking groove 28 of the terminal shield 4. In the shown embodiment of FIGS. 1 and 4, the impedance control portion 38 may have a width smaller than the maximum width of the transition portion 40. This adjustment of the width of the impedance control portion 38 represents one of the impedance control features 24. Because the discontinuity 22 of the terminal shield 4 of the shown embodiment results in a narrowed, inner diameter of the terminal shield 4, the cross-sectional area of the spring beam 32 needs to be reduced at the impedance control portion 38 in order to adjust the impedance of the spring beam 32 (the principles of the impedance control features have already been established in the above description of the present invention and will be omitted in this part).

In applications where the impedance of the at least one contact element 8 needs to be increased in order to arrive at the predefined, desired value, and to compensate for the influence of the discontinuity 22 of the terminal shield 4, the impedance control feature 24 may comprise or be a section with a reduced cross-section. This could be the case, for example, in areas where the discontinuity 22 of the terminal shield 4 results in a narrowed inner diameter in comparison to the rest of the terminal shield 4. In such a case, the cross-section reduction may be realized by an one-sidedly or two-sidedly decreased width of the at least one contact element 8. For a contact element 8 formed by a flat material, the width may be the dimension perpendicular to the material thickness and perpendicular to the insertion direction I. This will increase the impedance due to the reduced cross-sectional area, and due to the increased distance to the surface of the neighboring conductors. The reduction may be step-wise or gradual, e.g. by forming a U-shaped recess.

The above-mentioned width reduction may be implemented along the entire length of the discontinuity 22. Analogously, the cross-sectional area may be increased in applications with the need for a lowering of the impedance in order to arrive at the predefined, desired value and compensate for the influence of the discontinuity 22 of the terminal shield 4. This could be the case, for example, in areas where the discontinuity 22 of the terminal shield 4 results in a wider inner diameter in comparison to the rest of the terminal shield 4. In such a case, the at least one contact element 8 may comprise a section having an increased cross-section. The increase may result from an one-sidedly or two-sidedly increased width (for a contact element 8 formed by a flat material, the width may be the dimension perpendicular to the material thickness and perpendicular to the insertion direction I). This will decrease the impedance due to the increased cross-sectional area, and due to the decreased distance to the surface of the neighboring conductors.

The retention portion 42 may be positioned adjacent to the impedance control portion 38 and has a retention tab 50 shown in FIG. 1 protruding sideways in a direction perpendicular to the insertion direction I. The retention tab 50 may be a plate-shaped part formed integrally by the material of the corresponding spring beam 32.

The bonding portion 36 may be positioned adjacent to the retention portion 42 and has a bonding tab 52 protruding in the insertion direction I as a continuation of the spring beam 32, as shown in FIG. 1. The bonding tab 52 may be a plate-shaped part formed integrally by the material of the corresponding spring beam 32. In an embodiment, the bonding tab 52 has a width equal to the impedance control portion 38 and is configured for bonding with an electrical conductor 54 of a cable 56, as is shown in FIG. 8. The bonding portion 36 may be connected, e.g. welded or soldered, to the electrical conductor 54 of the cable 56.

The contact carrier 6 is made of an insulation material, which at least partially encloses the pair of contact elements 8. In an embodiment, both contact elements 8 of the pair of contact elements 8 are enclosed by the same contact carrier 6. In particular, the contact carrier 6 encloses the pair of contact elements 8 at the impedance control portion 38 and at the surrounding of the impedance control portion 38. In an embodiment, the insulation material has a relative permittivity higher than air.

As shown in FIGS. 1 to 6, the contact carrier 6 has at least two pieces 58 that are connected to each other to form the contact carrier 6. In an embodiment, one of the two pieces 58 is opaque and contains no color pigment. The other of the two pieces 58 contains color pigment, such as black and/or dark color pigment, so that the two pieces 58 may be connected through laser welding.

The contact carrier 6 may comprise a top piece 60 and a bottom piece 62, as shown in FIGS. 1 to 8, wherein the bottom piece 62 has a pair of retaining grooves 64. The pair of retaining grooves 64 extend parallel to each other in the insertion direction I. In particular, the pair of retaining grooves 64 is separated by an inner wall 66. Furthermore, at least a first segment 68 of each retaining groove 64 has a width configured to form-fit with the transition portion of one of the pair of contact elements 8. Thus, the pair of contact elements 8 may be received within the pair of retaining grooves 64 and sandwiched between the bottom piece 62 and the top piece 60, which is connected to the bottom piece 62, which prevents undesired dislocation of the contact elements 8 perpendicular to the insertion direction I. In another embodiment, the contact carrier 6 can be formed in a single piece around the contact elements 8, for example, by additive manufacturing.

In the shown embodiment of FIGS. 1 and 4, at least a second segment 70 of each retaining groove 64 has a width larger than the impedance control portion of one of the pair of contact elements 8. This creates multiple air-filled gaps 72 between the inner surfaces 74 of the pair of retaining grooves 64 and the lateral surfaces 76 of each of the pair of contact elements 8. These air-filled gaps 72 represent further impedance control features 24. In other embodiments, the gap 72 can be filled with air or any other dielectric material with a relative permittivity lower than the insulation material of the contact carrier 6.

Figure 3:
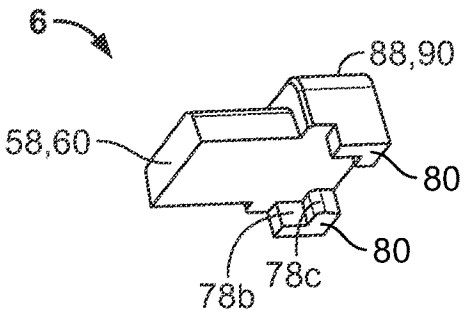
FIG. 3 is a perspective view of a top piece of a contact carrier of the contact terminal of FIG. 1.

As shown in FIGS. 3 and 4, at least one of the two, and both in an embodiment, pieces 58 of the contact carrier 6 have at least one support point 78 to abut onto the retention tab 50 of the spring beams 32. The top piece 60 has at least one step-like protrusion 80 projecting perpendicularly to the insertion direction I toward the bottom piece 62, and the bottom piece 62 has at least one step-like protrusion 82 projecting perpendicularly to the insertion direction I toward the top piece 60. In particular, the step-like protrusions 80, 82 may be configured pairwise for jointly accommodating the at least one retention tab 50 of the at least one contact element, and thus provide at least three support points 78*a*, 78*b*, 78*c*. The retention tab 50 may prevent an unwanted dislocation of the at least one contact element 8 and therefore facilitate the fixation of the at least one contact element 8 by the contact carrier 6.

Figure 6:
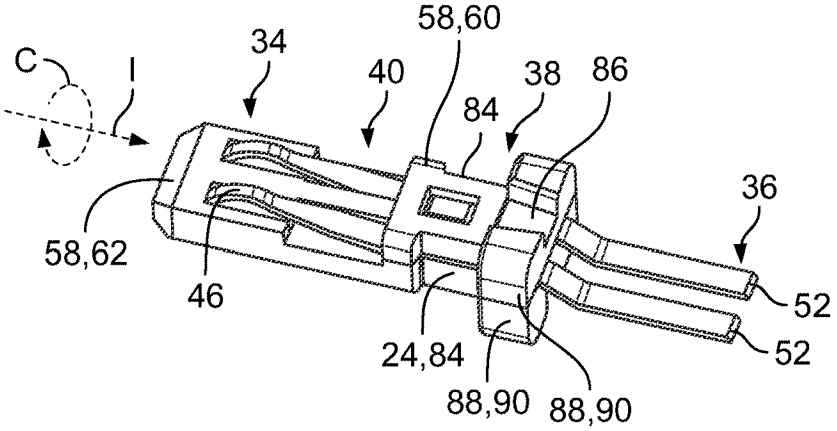
FIG. 6 is a perspective view of a contact carrier and a pair of contact elements according to another embodiment.

In the embodiments shown in FIGS. 5 and 6, the spring beams 32 and/or the contact carrier 6 each may comprise lateral recesses 84, which are aligned with the discontinuity 22. These lateral recesses 84 represent impedance control features 24, which can be implemented in addition or as an alternative to the above mentioned impedance control features 24. The lateral recesses 84 are substantially trapezoidal cut-outs extending through the material of the spring beams 32 and/or contact carrier 6 in a direction perpendicular to the insertion direction I. The cut-outs in the contact carrier 6 may at least partially expose the impedance control portion 38 of the spring beams 32. It will be appreciated by those skilled in the art that the cut-outs may also have a cuboid or round shape.

In an embodiment, at least one of the two, and both in an embodiment, pieces 58 of the contact carrier 6 have a slot 86 for interconnecting with a knob (not shown) of an adjacent component (not shown), e.g. a protective cover (not shown) for the bonding portion 36. The slot 86 may be a substantially cuboid notch on a side of the contact carrier 6, as shown in FIGS. 5 and 6.

As is shown in FIGS. 1, 7 and 8, the contact carrier 6 has a shoulder portion 88 that protrudes laterally from the contact carrier 6 and abuts against the locking element 26 of the terminal shield 4. The shoulder portion 88 may be a collar 90 extending along the outer circumference of the contact carrier 6. In particular, the top piece 60 may comprise one segment of the collar 90 on three sides of the top piece 60 and the bottom piece 62 may comprise the rest of the collar 90 on three sides of the bottom piece 62.

FIG. 9 shows a cable assembly 2 for high-frequency data transmission comprising a contact terminal 1 and a shielded cable 92 connected thereto, such as through a crimping connection. For this, the terminal shield 4 of the contact terminal 1 has a crimping portion 94 on the opposite of the forward end 16. The crimping portion 94 is formed as an integral part of the terminal shield 4 and extends coaxially with the shielded cable 92. Furthermore, the crimping portion 94 is wrapped around the shielded cable 92 in the circumferential direction C.

As shown in FIGS. 7 and 8, the shielded cable 92 comprises a pair of electrical conductors 54 of which each is connected with one bonding tab 52 of the pair of spring beams 32 of the contact terminal 1. In an embodiment, the connection is a welding connection.

The cable assembly 2 may have along its entire length a substantially consistent impedance amounting to a predefined, desired value according to the frequency of the data transmission. In particular, the impedance may vary within a range of +/−5% from the predefined, desired value. A deviation within this range is regarded as being of the predefined, desired value. This way, signal integrity may be ensured for the entire cable assembly 2. Thus, overall transmission performance is improved.

The invention at least partially compensates for a deteriorating influence of the discontinuity 22 of the terminal shield 4 in order to allow for greater design freedom and to improve transition points between the shielded transmission line components for high-frequency data transmission, in terms of signal integrity.

What is claimed is:

1. A contact terminal, comprising:

a terminal shield;

a contact carrier; and a contact element for conducting electrical signals of a high-frequency data transmission, the contact carrier retains the contact element in a fixed position within the terminal shield, the terminal shield has a discontinuity that affects an impedance of the contact element, at least one of the contact carrier and the contact element has an impedance control feature configured to adjust the impedance of the contact element to a predefined desired value according to a frequency of the data transmission, the impedance control feature is an adjusted cross-sectional area of the contact element at an impedance control portion.

2. The contact terminal of claim 1, wherein the contact carrier and the contact element each have the impedance control feature.

3. The contact terminal of claim 1, wherein the discontinuity is a locking element formed in an outer circumference of the terminal shield.

4. The contact terminal of claim 3, wherein the impedance control feature is aligned with the locking element.

5. The contact terminal of claim 4, wherein the locking element is a locking groove extending at least partly along the outer circumference of the terminal shield.

6. The contact terminal of claim 1 wherein the contact element has a transition portion with a cross-sectional area larger than a cross-sectional area of the impedance control portion.

7. The contact terminal of claim 1, wherein the contact element has a retention portion with a retention tab protruding sideways.

8. The contact terminal of claim 1, wherein the contact element is one of a pair of contact element positioned spaced apart and electrically isolated from each other.

9. The contact terminal of claim 8, wherein each of the pair of contact elements is configured to transmit one signal of a differential pair of signals for the high-frequency data transmission.

10. The contact terminal of claim 1, wherein the contact carrier is made of an insulation material at least partly enclosing the contact element.

11. The contact terminal of claim 10, wherein the impedance control feature is an adjusted material thickness of the contact carrier.

12. The contact terminal of claim 1, wherein the impedance control feature is a gap at least partially separating the contact element from the contact carrier.

13. The contact terminal of claim 1, wherein the impedance control feature is a lateral recess on the contact carrier and/or on the contact element.

14. The contact terminal of claim 1, wherein the terminal shield has a section with a reduced cross-section and the contact element has a cross-section reduction.

15. The contact terminal of claim 14, wherein the cross-section reduction overlaps with the section with the reduced cross-section in a direction perpendicular to an insertion direction.

16. The contact terminal of claim 1, wherein the terminal shield has a section with an increased cross-section and the contact element has a cross-section increase.

17. The contact terminal of claim 16, wherein the cross-section increase overlaps with the section with the increased cross-section in an insertion direction.

18. The contact terminal of claim 1, wherein the terminal shield and the contact carrier engage in a form-fit connection.

19. The contact terminal of claim 18, wherein the discontinuity is part of the form-fit connection.

* * * * *